US006095452A

United States Patent [19]

Leskinen

[11] Patent Number: 6,095,452

[45] Date of Patent: Aug. 1, 2000

[54] METHOD AND ARRANGEMENT FOR WINDING A WEB

[75] Inventor: Arto Leskinen, Nukari, Finland

[73] Assignee: Valmet Corporation, Helsinki, Finland

[21] Appl. No.: 09/227,808

[22] Filed: Jan. 11, 1999

[30] Foreign Application Priority Data

Feb. 4, 1998 [FI] Finland ..... 980252

[51] Int. Cl.[7] ..... B65H 18/10; B65H 23/032

[52] U.S. Cl. ..... 242/534; 242/534.1; 242/541.7

[58] Field of Search ..... 242/534, 534.1, 242/541.4, 541.5, 541.6, 541.7, 547, 410, 413

[56] References Cited

U.S. PATENT DOCUMENTS

| | | | |
|---|---|---|---|
| 3,570,735 | 3/1971 | Kurz | 242/534.1 |
| 3,810,590 | 5/1974 | Miyake | 242/534.1 |
| 4,500,045 | 2/1985 | Whitaker et al. | 242/534.1 |
| 4,679,744 | 7/1987 | Chikamasa et al. | 242/534 |
| 5,732,902 | 3/1998 | Tomma et al. | 242/541.5 |
| 5,988,558 | 11/1999 | Koike et al. | 242/534 |

FOREIGN PATENT DOCUMENTS

| | | | |
|---|---|---|---|
| 1219576 | 6/1966 | Germany . | |
| 3721969 | 1/1989 | Germany . | |
| 36-0238032 | 11/1985 | Japan | 242/534.1 |
| 36-0238033 | 11/1985 | Japan | 242/534.1 |
| 36-1017324 | 1/1986 | Japan | 242/534.1 |
| 36-2040932 | 2/1987 | Japan | 242/534.1 |
| 40-2207920 | 8/1990 | Japan | 242/534.1 |

OTHER PUBLICATIONS

Abstract of Japanese Patent No. 63–123743.

*Primary Examiner*—John M. Jillions
*Attorney, Agent, or Firm*—Steinberg, Raskin & Liberchuk, P.C.

[57] ABSTRACT

Method and arrangement for winding a web wherein a roll being formed is supported in an axial direction of the roll by first and second support members placed at sides of the roll. The shape of the end of the roll being formed is measured indirectly or directly, and the relative positions of the support members in relation to one another are regulated based on the measurement. As indirect measurement, it is possible to measure forces in the axial direction of the roll, and as direct measurement, it is possible to measure the side line of a roll end directly by contact measurement or contact-free measurement. Based on the measurements, the relative positions of the support members in relation to one another are regulated such that any defects in the shape at the ends of the roll being formed can be prevented.

20 Claims, 4 Drawing Sheets

METHOD AND ARRANGEMENT FOR WINDING A WEB

FIELD OF THE INVENTION

The present invention relates to a method and arrangement for winding a web onto a roll spool to form a roll about the roll spool which is supported in an axial direction of the roll by first and second support members placed at sides of the roll.

BACKGROUND OF THE INVENTION

With respect to related prior art, reference is made to the current assignee's Finnish Patent Application No. 942451 (corresponding to U.S. Pat. No. 5,732,902, the specification of which is incorporated herein by reference) which describes a method and device for winding a web. In the method, the web is wound onto a roll spool on support of a support roll and through a nip formed between the support roll and the roll being produced. The spool is supported at least partly by means of a support member arranged in the center of the spool. The spool and the roll are supported and/or loaded by means of a device whose position can be varied. In the initial stages of winding, the loading and support units of the device are shifted substantially in a plane passing through the axes of the support roll and the roll being produced in order to load and/or support the roll being produced in the winding position. When the winding makes progress, the loading and support units of the device are shifted downwards along a path substantially parallel to the circumference of the roll, and in the final stages of winding, the roll that is being completed is supported by means of the loading and support units from underneath. By means of the invention described in Finnish Patent Application No. 942451, it is possible to wind rolls having a large size without faults, i.e., rolls having a diameter of even more than about 1.5 meters and a width of even more than about 3 meters.

However, in all center-drive winders, dishing of the roll occurs, in particular with larger roll diameters. Dishing is understood as a fault of the shape of the roll which arises from the fact that the web layers on the roll are shifted during winding in the axial direction of the roll (laterally). Owing to this effect, the shape of the ends of the roll take a form different from a plane shape, i.e., the ends of the roll become convex or concave, thereby causing an error in the shape of the roll. When such lateral shifting starts, it generally tends to intensify itself and ultimately has the consequence that the roll end becomes convex unless correcting operations are carried out early enough. The phenomenon arises from the fact that, between the surface layers of the roll, a slight extent of gliding always takes place during winding as a result of forces applied to the web in the nip. Owing to this gliding of the surface layers of the roll, the roll tightness is increased, and if these forces that increase the tightness are out of balance, for example, owing to uneven tension profile or thickness profile of the incoming web, the layers of web also tend to be shifted in the axial direction of the roll spool.

Also, faults in the alignment of the roll supports cause a similar error in the shape of the roll, and so does an uneven distribution of the nip force. Such an error in the shape of a roll is undesirable because of the problems that arise during unwinding of the roll.

OBJECTS AND SUMMARY OF THE INVENTION

Accordingly, it is an object of the present invention to provide a method and arrangement for winding a web by whose means this error in the shape of the roll, which occurs in particular in large rolls, can be counteracted.

It is another object of the present invention to provide a new and improved method and arrangement for winding a roll.

Briefly, these objects and others are attained by the method in accordance with the invention which comprises the steps of measuring the shape of the ends of the roll being formed, i.e., the roll being formed by the winding of the web about a roll spool, and regulating the positions of first and second support members which support a respective axial end of the roll in relation to one another based on the measured shape of the ends of the roll. In this manner, defects in the shape in the ends of the roll and thus any errors in the shape of the roll are substantially avoided.

The method in accordance with the invention can be utilized in all such winding methods in which the direction of arrival of the web to be wound onto the roll can be regulated in relation to the axis of the roll or in which the winding is carried out by means of a winding nip in which the distribution of loading in the direction of width of the nip can be regulated. Thus, the method is also suitable for nip-free center-drive winding in which the tension of the web on the roll is regulated exclusively by means of the torque of rotation applied to the shaft of the web roll.

In the method in accordance with the invention, it is possible to use indirect or direct measurement, on whose basis it is concluded whether an error in the shape of the roll (also referred to as an error of shape) is being formed in the roll. Direct measurement is understood to connote a measurement in which the side line of the roll end is measured directly by means of a measurement free of contact or with contact. On the other hand, indirect measurement is understood to connote a measurement in which changes in the side line of the roll end are measured indirectly from some other such quantity which is affected by changes in the side line of the end of the roll.

The arrangement for winding a web in accordance with the invention comprises first and second support members for supporting a respective axial end of the roll being formed, measuring means for measuring a force in the web in an axial direction of the roll, and regulating means coupled to the measuring means for regulating the position of the first and second support members in relation to one another based on the measured force in the axial direction of the roll. The arrangement may include a movable first sledge on which the first support member is mounted, and a movable second sledge on which the second support member is mounted. In this case, the measuring means may comprise a force detector coupled to each sledge for measuring movement of each sledge, if any, resulting from the force in the web in the axial direction of the roll. Also, the regulating means may then comprise a first loading cylinder mounted on the first sledge and pivotally coupled to the first support member to enable the first end of the roll to be moved, a second loading cylinder mounted on the second sledge and pivotally coupled to the second support member to enable the second end of the roll to be moved, and a regulator coupled to each force detector and to a respective loading cylinder. In this manner, any force in the web in the axial direction of the roll is measured by the force detectors and any required relative positional movement of the first and second support members is determined by the regulators and conveyed by the regulators to one of the loading cylinders to thereby move one of the first and second support members and thus one axial end of the roll to change the nip line.

In another arrangement, the first and second sledges include front wheels proximate the roll and rear wheels distant the roll and each rear wheel includes an eccentric shaft. The regulating means may then comprise a regulator coupled to each force detector and to the eccentric shafts of the rear wheels of a respective sledge such that any force in the web in the axial direction of the roll is measured by the force detectors and any required relative positional movement of the first and second support members is determined by the regulators. The regulators cause rotation of the eccentric shafts of the rear wheels to thereby move one of the first and second support members and thus one of the axial ends of the roll to change the nip line.

The invention will be described in detail with reference to some preferred embodiments of the method in accordance with the invention illustrated in the figures in the accompanying drawings. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
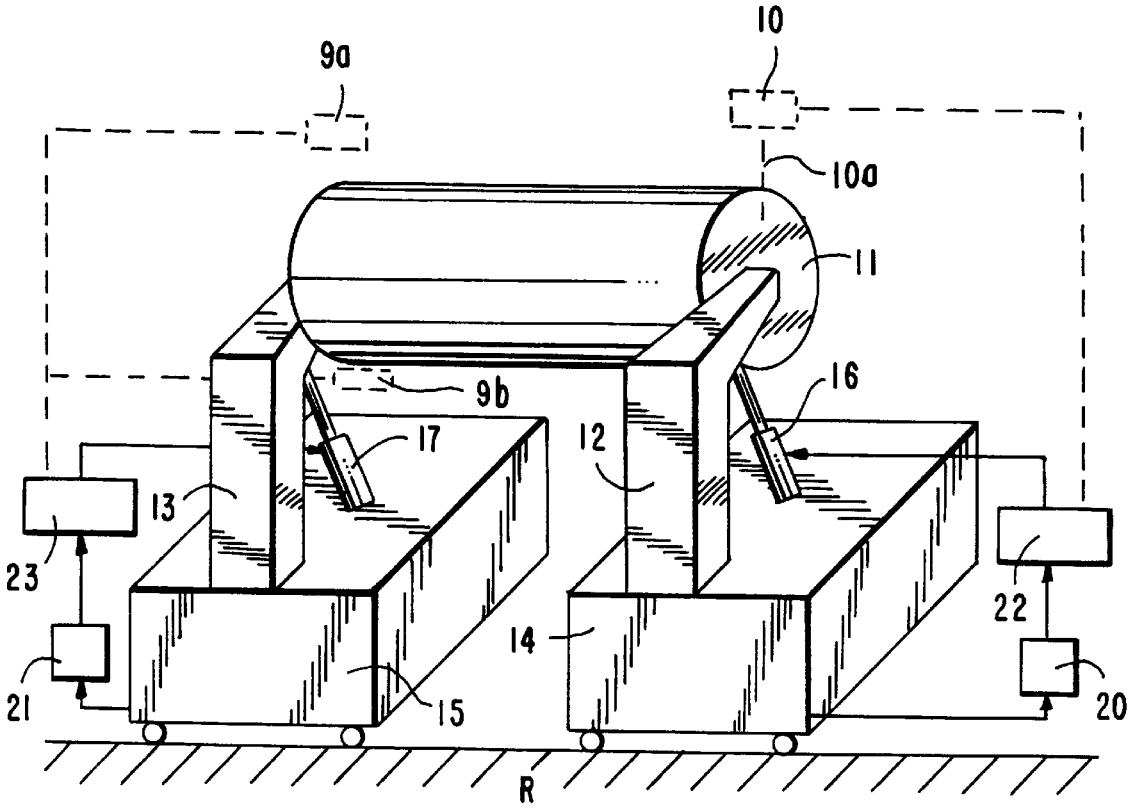
FIG. 1 is a schematic perspective view of a center-drive winder in which the method in accordance with the invention can be applied.
Figure 2:
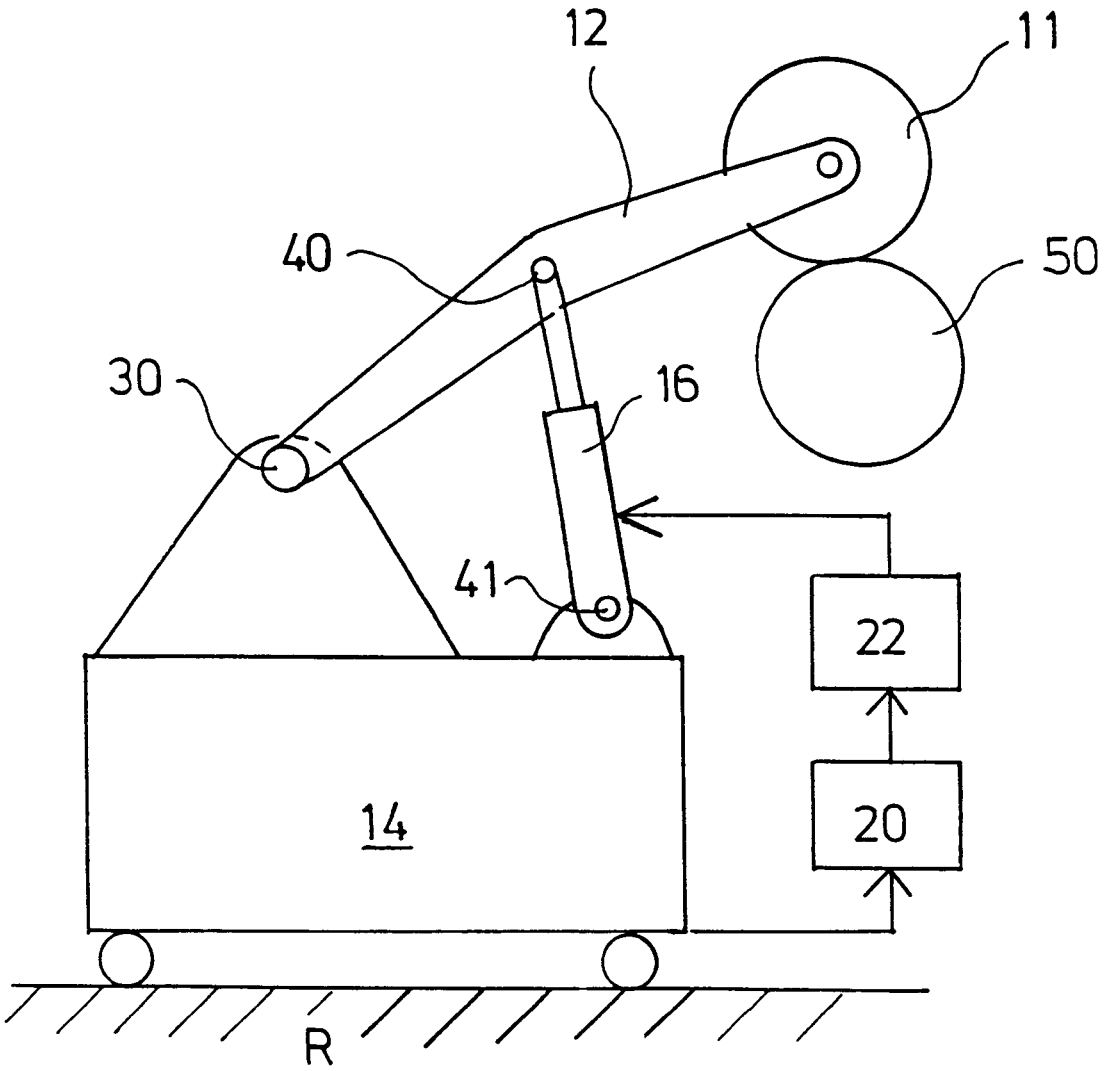
FIG. 2 is a schematic side view of the center-drive winder shown in FIG. 1.

Referring to the accompanying drawings wherein like reference characters refer to the same or similar elements, FIG. 1 is a schematic perspective view of a center-drive winder and FIG. 2 is a side view of the center-drive winder shown in FIG. 1. FIGS. 1 and 2 also illustrate a mode in accordance with the present invention for regulating the nip line between a roll 11 that is being formed and a support roll 50 in the center-drive winder. Herein, a center-drive winder connotes in particular a winder of the type used in connection with a slitter-winder, in which the rolls formed out of component webs are supported, each of them separately, from the ends of their roll spools and at least from one point at the side of the web roll by means of a support roll or an equivalent support member. The invention is not limited to use in a center-drive winder.

In FIG. 1, the roll 11 that is being formed is supported from both of its ends by means of support members such as winding arms 12, 13 coupled to the roll spool. The first winding arm 12 is coupled with a first sledge 14 by means of an articulated joint 30 (FIG. 2), and the second winding arm 13 is coupled with a second sledge 15 in a similar way by means of an articulated joint. The first sledge 14 and the second sledge 15 are arranged on a frame R of the center-drive winder so that they can be displaced in relation to the frame R depending on the length of the reel spool and on the location of the point of feed of the web to be wound. A first loading cylinder 16 is attached at an end thereof to the first winding arm 12 by means of an articulated joint 40 (FIG. 2), and similarly, a second loading cylinder is attached at an end thereof to the second winding arm 13 by means of an articulated joint. The other end of the first loading cylinder 16 is attached by means of an articulated joint 41 to the first sledge 14, and the other end of the second loading cylinder 17 is attached similarly by means of an articulated joint to the second sledge 15. By means of the loading cylinders 16, 17, the roll 11 that is being wound can be loaded in the desired way against the support roll 50.

A first force metering detector 20 is arranged in connection with the first sledge 14 and similarly, a second force metering detector 21 is arranged in connection with the second sledge 15. The force metering detectors 20, 21 can be placed, for example, between the sledges 14, 15 and their brakes. Alternatively, the force metering detectors 20, 21 can be placed in connection with support seats of the roll 11 being formed. The force metering detectors 20, 21 meter the force acting in the direction of the axis of the roll spool (which is also the axis of the roll being formed), which force is transferred from the roll spool to the winding arms 12, 13 and further to the sledges 14, 15. The detected force is converted into signals by the force metering detectors 20,21.

The signal received from the first force metering detector 20 is passed to a first regulator 22, and the signal received from the second force metering detector 21 is passed to a second regulator 23. By means of the first regulator 22, the actuating system, e.g., hydraulic system, of the first loading cylinder 16 is controlled, and by means of the second regulator 23, the hydraulic system of the second loading cylinder 17 is controlled. The signals of the force metering detectors 20, 21 can also be passed to a separate computer or to a computer that controls the whole winding process, in which case the control of the regulators 22, 23 takes place by means of the computer. In such a case, the information obtained in connection with winding can be used as a part of the data connected with the roll 11, which data can be used later in connection with unwinding of the roll 11, for example in a printing machine.

In use, at the beginning of winding, the axial press forces applied to the ends of the roll spool are reset to zero, in which case, the total metering signal of the force metering signals 20,21 is zero. After this, if a force parallel to the axis of the roll spool occurs in the web that is being wound onto the roll 11, which force, thus, attempts to shift the layers of the web in the direction of its effect, the force is also detected as a change in the metering signal given by the force metering detectors 20,21. The force measured at the metering detector 20,21 in whose direction the roll 11 is dishing is increased, and the force measured at the metering detector 20,21 placed at the opposite side is reduced. The reel spool presses the winding arm 12,13 towards which the web is shifting and produces a force signal in the respective force metering detector 20, 21. This signal gives an impulse to the respective regulator 22, 23, which gives a command to the hydraulic system to adjust the position of the loading cylinder 16, 17 (the position of one of the loading cylinders 16,17 is thus "corrected" to cause the nip line to be changed and thereby counteract the axial force of the roll). When the loading cylinder 16, 17 is adjusted, the associated winding arm 12,13 is raised or lowered in relation to the other winding arm (and the end of the roll supported by the associated winding arm 12,13 is moved), the nip force profile between the roll 11 and the support roll 50 is changed so that the nip line is thereby inclined (see FIGS. 4A and 4B). By means of such a correction, the force that is applied to the roll 11 being formed and that diverts the web layers can be eliminated, in which case, the web layers do not attempt to move in the axial direction of the roll spool, and dishing of the roll 11 is prevented.

Figure 3B:
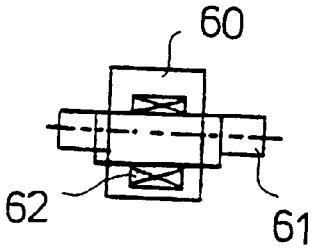
FIG. 3 illustrates a mode of regulation of the nip line, in which an actuator is arranged in connection with the suspension of a wheel of a sledge.
Figure 3A:
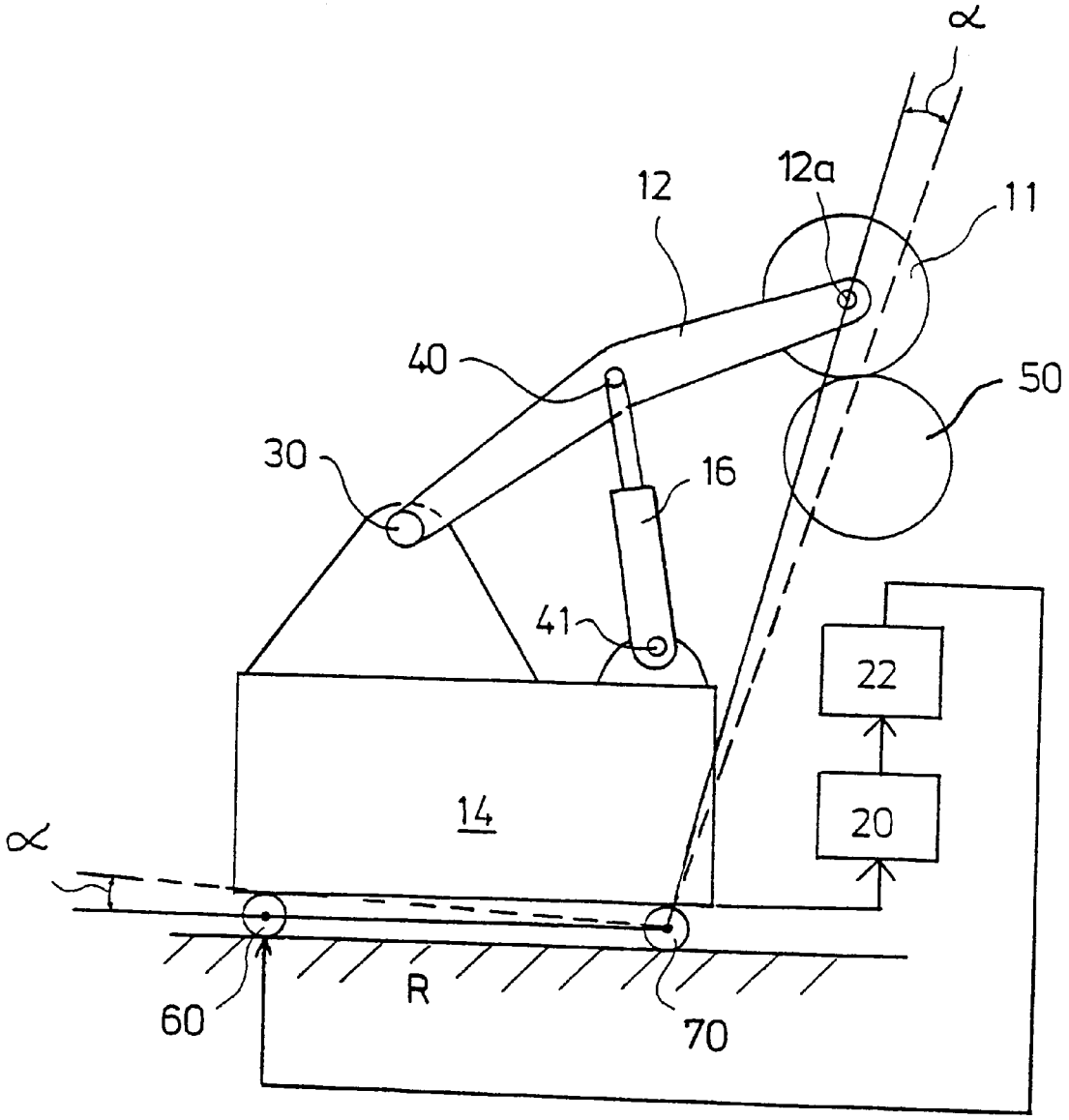

FIG. 3A illustrates a second mode of regulation of the nip line in accordance with the present invention, which regulation takes place by means of an actuator arranged in connection with the suspension of a wheel of the sledge. In this embodiment, the regulators 22, 23 control an actuator arranged in connection with wheels of the sledges 14, 15. The actuator comprises rear support wheels 60 of the sledge 14 (those more distant from the roll being formed), which have been mounted revolvingly on an eccentric shaft 61 by means of a bearing 62 as shown in FIG. 3B. When the eccentric shaft 61 is rotated, the rear edge of the sledge 14 can be raised in relation to its forward edge, which causes a rotation of the sledge 14 around the axis of its front wheels 70 (those wheels proximate the roll being formed). Owing to the rotation, the support point 12*a* of the roll 11 on the support arm 12 attached to the sledge 14 is shifted by the angle $\alpha$, and when the other sledge 15 remains stationary, the direction of the axis of the roll 11 is altered in relation to the running direction of the web that is being fed onto the roll, and the axial force in the interior of the roll 11 is compensated for, in which case formation of an error of shape in the roll 11 is prevented.

Also in the embodiments of FIGS. 3A and 3B, the force detectors 20, 21 can be placed, for example, between the sledges 14, 15 and their brakes, or in connection with the support seats of the roll 11 being formed. Likewise, the signals of the force detectors 20, 21 can be passed to the computer, which again controls the regulators 22, 23.

Figure 4A:
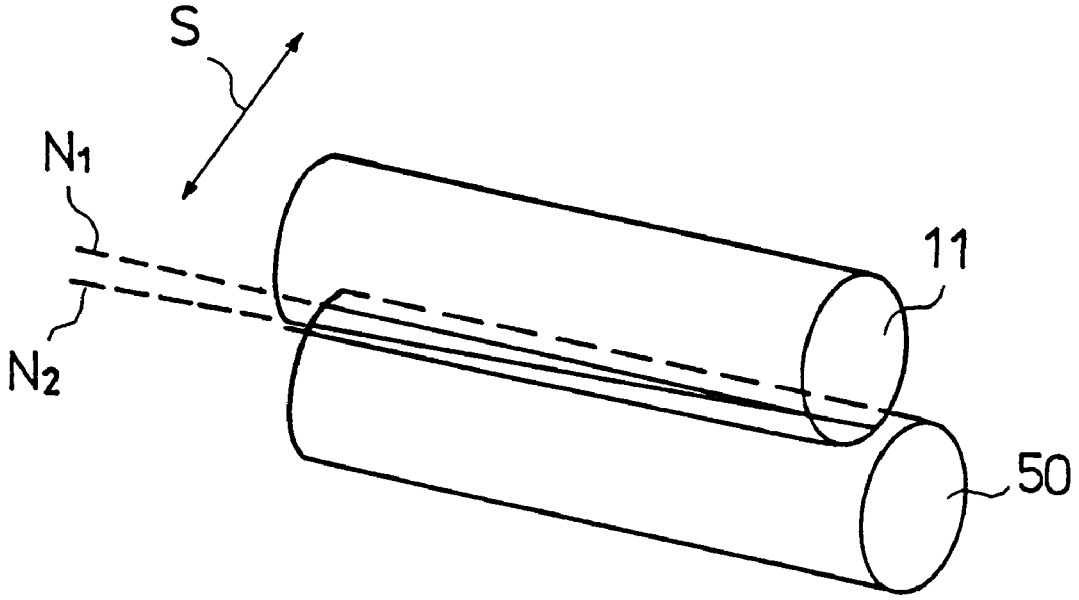
FIG. 4 illustrates the change in direction produced by the actuator shown in FIG. 3 in the nip line between the roll that is being formed and the support roll.
Figure 4B:
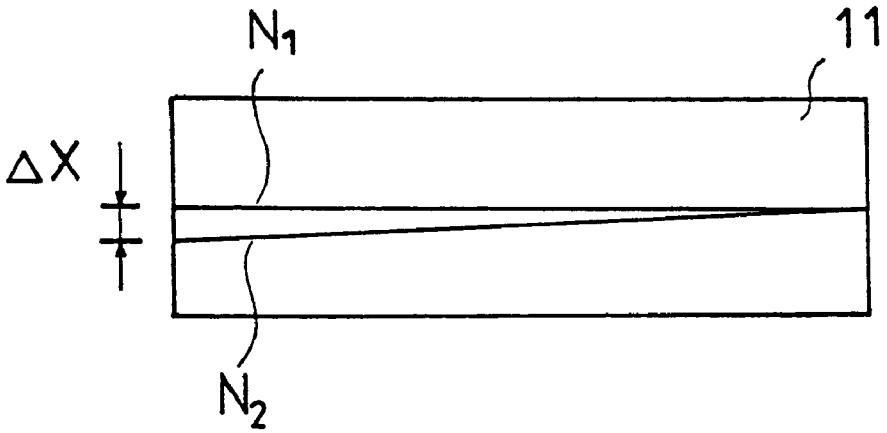

FIG. 4A illustrates the direction of movement produced by the actuator at one end of the roll 11 as a perspective illustration, and FIG. 4B illustrates the effect of the regulation on the position of the winding nip on the face of the roll 11 and, at the same time, the effect on the relative direction of arrival of the web in relation to the axis of the roll 11. When one end of the roll 11 is shifted in the way indicated by the arrow S while the other end of the roll 11 remains in its place, the nip line $N_1$ between the roll 11 and the support roll 50 is changed into the nip line $N_2$. At the stationary roll end, the nip lines $N_1$ and $N_2$ come together, and at the roll end that is shifted, the nip lines $N_1$ and $N_2$ are placed at the distance $\Delta x$ from one another. By means of such an arrangement, axial shifting of the web wound onto the roll 11 can be prevented, so that the ends of the roll 11 to be wound become planar.

Instead of metering of the transverse forces applied to the sledges 14, 15, the side plane of the roll 11 (i.e., the shape of the ends of the roll) can also be measured directly, e.g., by means of photocells, an ultrasound detector, or by means of capacitive or contact measurement. For example, as shown in phantom in FIG. 1, the side plane position of the roll 11 can be measured by direct contact measurement (e.g. by measuring the axially location of the uppermost layers of the web by direct contact). The direct contact measurement means are depicted in phantom as 10 and 10*a* in FIG. 1. Alternatively, the axially position of the uppermost layers of the web on the roll can be measured by a contact-free measurement means (e.g. photocells). The contact free measurement means are generally depicted in phantom as 9*a* and 9*b* in FIG. 1. Compared with these direct measurements, the metering of lateral forces is, however, preferable, because by its means it is possible to see considerably earlier indirectly when such a force arising from the winding nip or from profile errors in the web is applied to the roll 11 as attempts to divert the web layers to be wound onto the roll 11 from their desired position, and measures of correction can be initiated earlier.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

I claim:

1. In a method for winding a web in which the web is wound onto a roll spool to form a roll in connection therewith, the roll being supported in an axial direction by first and second support members each arranged at a respective end of the roll, the improvement comprising the steps of:

measuring the shape of the ends of the roll, and regulating the position of the first and second support members in relation to one another based on the measured shape of the ends of the roll to thereby reduce defects in the shape in the ends of the roll.

2. The method of claim 1, wherein the shape of the ends of the roll is measured by direct measurement.

3. The method of claim 1, wherein the shape of the ends of the roll is measured by indirect measurement.

4. The method of claim 3, wherein the step of measuring the shape of the ends of the roll by indirect measurement comprises the step of:

metering forces applied in the axial direction of the roll, the position of the first and second support members being regulated based on the metered forces.

5. The method of claim 4, wherein the forces applied in the axial direction of the roll are metered at least in connection with one of the first and second support members.

6. The method of claim 1, wherein the step of measuring the shape of the ends of the roll comprises the step of metering axial forces applied to the roll, the position of the first and second support members being regulated based on the metered forces.

7. The method of claim 6, wherein the axial forces applied to the roll are metered in connection with the first and second support members.

8. The method of claim 7, further comprising the step of:

determining a resultant of the axial forces applied to the roll which constitutes a difference between the metered axial forces, the position of the first and second support members being regulated based on the determined resultant.

9. The method of claim 1, wherein the step of measuring the shape of the ends of the roll comprises the step of metering axial forces applied to the roll, the step of regulating the position of the first and second support members comprising the step of adjusting a load applied to the roll through the first support member based on data obtained from the metering of the axial forces applied to the roll.

10. The method of claim 1, wherein the step of measuring the shape of the ends of the roll comprises the step of metering axial forces applied to the roll, the step of regulating the position of the first and second support members comprising the step of shifting the first support member based on data obtained from the metering of the axial forces applied to the roll to thereby change a running direction of the web that is passed onto a face of the roll in relation to the axis of the roll.

11. The method of claim 1, wherein the step of measuring the shape of the ends of the roll comprises the step of measuring the location of uppermost layers of the web being wound onto the roll spool in the axial direction of the roll, the position of the first and second support members being regulated based on the measured location of the uppermost layers of the web.

12. The method of claim 11, wherein the location of the uppermost layers of the web is measured by a contact-free measurement method.

13. The method of claim 11, wherein the location of the uppermost layers of the web is measured by a measurement method in which the web is contacted.

14. The method of claim 11, wherein the step of regulating the position of the first and second support members comprises the step of adjusting a load applied to the roll through the first support member based on data obtained from the measurement of the location of the uppermost layers of the web.

15. The method of claim 11, the step of regulating the position of the first and second support members comprising the step of shifting the first support member based on data obtained from the measurement of the location of the uppermost layers of the web to thereby change a running direction of the web that is passed onto a face of the roll in relation to the axis of the roll.

16. In an arrangement for winding a web including a roll spool about which a web is wound to form a roll in connection therewith, comprising first and second support members for supporting a respective first and second axial end of the roll, measuring means for measuring a force in the web in an axial direction of the roll, and regulating means coupled to said measuring means for regulating the position of said first and second support members in relation to one another based on the measured force in the axial direction of the roll.

17. The arrangement of claim 16, further comprising a movable first sledge on which said first support member is mounted, and a movable second sledge on which said second support member is mounted, said measuring means comprising a force detector coupled to each of said first and second sledges for measuring movement of said first and second sledges resulting from the force in the web in the axial direction of the roll.

18. The arrangement of claim 17, wherein said regulating means comprise a first loading cylinder mounted on said first sledge and pivotally coupled to said first support member to enable the first end of the roll to be moved, and a second loading cylinder mounted on said second sledge and pivotally coupled to said second support member to enable the second end of the roll to be moved.

19. The arrangement of claim 18, wherein said regulating means further comprise a regulator coupled to each of said force detectors and to a respective one of said first and second loading cylinders such that the force in the web in the axial direction of the roll is measured by said force detectors and any positional movement of said first and second support members is determined by said regulators and conveyed by said regulators to said first and second loading cylinders to thereby move one of said first and second support members and thus one of the axial ends of the roll.

20. The arrangement of claim 17, wherein said first and second sledges include front wheels proximate the roll and rear wheels distant the roll, each of said rear wheels including an eccentric shaft, said regulating means comprising a regulator coupled to each of said force detectors and to said eccentric shafts of said rear wheels of a respective one of said first and second sledges such that the force in the web in the axial direction of the roll is measured by said force detectors and any positional movement of said first and second support members is determined by said regulators and said regulators cause rotation of said eccentric shafts of said rear wheels to thereby move one of said first and second support members and thus one of the axial ends of the roll.

* * * * *